US009806476B2

(12) United States Patent
Long

(10) Patent No.: US 9,806,476 B2
(45) Date of Patent: Oct. 31, 2017

(54) ELECTRICAL CONNECTOR WITH A MATING CONNECTOR DETECTION

(71) Applicant: LOTES CO., LTD, Keelung (TW)

(72) Inventor: Quan Long, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 15/449,077

(22) Filed: Mar. 3, 2017

(65) Prior Publication Data

US 2017/0279232 A1 Sep. 28, 2017

(30) Foreign Application Priority Data

Mar. 25, 2016 (CN) ..... 2016 2 0235636 U

(51) Int. Cl.

| | |
|---|---|
| ***H01R 24/00*** | (2011.01) |
| ***H01R 33/00*** | (2006.01) |
| ***H01R 24/60*** | (2011.01) |
| ***H01R 13/6581*** | (2011.01) |
| *H01R 107/00* | (2006.01) |

(52) U.S. Cl.
CPC ..... *H01R 24/60* (2013.01); *H01R 13/6581* (2013.01); *H01R 2107/00* (2013.01)

(58) Field of Classification Search
CPC ..... H01R 23/02; H01R 24/60; H01R 24/62; H01R 24/64; H01R 13/6464; H01R 13/6466
USPC ..... 439/660, 676, 60, 924.1
See application file for complete search history.

(56) References Cited

U.S. PATENT DOCUMENTS

| | | | | |
|---|---|---|---|---|
| 7,604,512 | B1 * | 10/2009 | Chen | H01R 13/5045 439/660 |
| 7,798,832 | B2 * | 9/2010 | Qin | H01R 13/7035 439/188 |
| 8,398,416 | B2 * | 3/2013 | Tseng | H01R 13/6658 439/188 |
| 8,545,273 | B1 * | 10/2013 | Chen | H01R 13/6658 439/660 |
| 8,602,825 | B2 * | 12/2013 | Chen | H01R 13/6658 439/660 |

(Continued)

FOREIGN PATENT DOCUMENTS

CN 202395210 U 8/2012

*Primary Examiner* — Hae Moon Hyeon
(74) *Attorney, Agent, or Firm* — Locke Lord LLP; Tim Tingkang Xia, Esq.

(57) ABSTRACT

An electrical connector for connecting a mating connector includes a main body having a terminal slot, a tongue extending from the main body, and first and second terminals. The terminal slot extends to a mating surface of the tongue. The first terminal has a first extending portion received in the terminal slot and a first contacting portion extending from the first extending portion. The second terminal has a second extending portion received in the terminal slot and a second contacting portion extending toward the mating surface and bending backward. The second extending portion is away from the mating surface relative to the first extending portion. The first and second contacting portions expose out of the mating surface and are arranged front and back. When the electrical connector connects the mating connector, the first and second terminals contact the mating connector to form an electrical circuit.

10 Claims, 8 Drawing Sheets

(56) References Cited

U.S. PATENT DOCUMENTS

| | | | | |
|---|---|---|---|---|
| 8,715,010 | B2 * | 5/2014 | Wang | H01R 13/7031 439/660 |
| 9,543,714 | B2 * | 1/2017 | Chang | H01R 13/6272 |

* cited by examiner

ELECTRICAL CONNECTOR WITH A MATING CONNECTOR DETECTION

CROSS-REFERENCE TO RELATED APPLICATIONS

This non-provisional application claims priority to and benefit of, under 35 U.S.C. §119(a), Patent Application No. 201620235636.9 filed in P.R. China on Mar. 25, 2016, the entire content of which is hereby incorporated by reference.

FIELD OF THE INVENTION

The present invention relates to an electrical connector, and more particularly to an electrical connector having a detection function.

BACKGROUND OF THE INVENTION

An electrical connector realizes signal transmission or power supply by contacting with a mating connector. A common electrical connector is covered by a metal shell, thus whether the mating connector is inserted in place cannot be directly perceived. At this moment, a detection terminal is often used to detect whether the mating connector is inserted in place.

For instance, an electrical connector (Chinese patent application number CN201120468340) is disclosed. Referring to FIG. 1, the electrical connector includes an insulating body 1' provided with a first terminal slot 13' and a second terminal slot 13" that are adjacent to each other. A detection terminal 2' is received in the first terminal slot 13'. The detection terminal 2' includes a first main body portion 21' extending forward and a first contacting portion 22' transversely and reversely bending and extending from the front end of the first main body portion 21' toward the second terminal slot 13'. An upper terminal 3' is received in the second terminal slot 13'. The upper terminal 3' has a second main body portion 31' and a second contacting portion 32' bending and extending upward from the front end of the second main body portion 31', and the second contacting portion 32' is located right in front of the first contacting portion 22'. When connected with a mating connector, the detection terminal 2' and the upper terminal 3' form an electrical circuit to achieve a detection function. However, as the first contacting portion 22' and the first main body portion 21' are not on the same straight line, when the mating connector is inserted, the first contacting portion 22' very easily generates defects such as warping. Meanwhile, the first contacting portion 22' is very close to the second main body portion 31' and the second contacting portion 32', after the mating connector (not shown) is inserted, the first contacting portion 22' easily forms direct contact with the second main body portion 31' or the second contacting portion 32'. When the mating connector is pulled out, the direct contact cannot be separated immediately due to electric power. Particularly after the mating connector is pulled and inserted repeatedly, even permanent direct contact may happen, thus seriously affecting on time detection and accurate detection.

Therefore, it is necessary to design a new electrical connector which is accurate in detection, cannot misjudge, and is steady in structure, so as to solve the foregoing problem.

SUMMARY OF THE INVENTION

In one aspect, the present invention relates to an electrical connector that can accurately detect whether a mating connector is inserted, and is stable in terminal structure.

In certain embodiments, an electrical connector is used for connecting a mating connector. The electrical connector includes a main body, a tongue, a first terminal and a second terminal. The tongue extends forward from the main body and is used for mating with the mating connector. The main body is provided with a first terminal slot extending to a mating surface of the tongue. The first terminal has a detection function, and has a first extending portion received in the first terminal slot. A first contacting portion is formed on the first extending portion and is exposed out of the mating surface of the tongue. The second terminal has a second extending portion received in the first terminal slot, and is away from the mating surface of the tongue relative to the first extending portion. The second extending portion bends toward the mating surface of the tongue and backward to form a second contacting portion. The second contacting portion exposes on the mating surface of the tongue, and the second contacting portion and the first contacting portion are arranged along a front and back direction. When the electrical connector connects with the mating connector, the first terminal and the second terminal simultaneously contact with the mating connector, so as to form an electrical circuit.

In certain embodiment, the mating connector is provided with at least one mating terminal, and the first terminal and the second terminal both contact with the mating terminal.

In certain embodiment, the tongue is provided with a matching surface opposite to the mating surface. The main body is provided with a first surface located on the same side with the mating surface and a second surface located on the same side with the matching surface. The first terminal slot has a first groove recessed from the first surface to the inside of the main body, a second groove recessed from the second surface to the inside of the main body, and a through slot running through the mating surface and the matching surface.

In certain embodiment, the first terminal slot is internally provided with a separating plate extending from the main body to the through slot. The first groove and the second groove are located on two opposite sides of the separating plate. The first extending portion extends backward to form a first fixing portion, and the first fixing portion is retained in the first groove. The second extending portion extends backward to form a second fixing portion, and the second fixing portion is retained in the second groove and the through slot. The first contacting portion and the second contacting portion are exposed outside the through slot.

In certain embodiment, left and right sides of the separating plate are respectively provided with a third groove recessed from the matching surface toward the mating surface. Two side edges of the second fixing portion respectively bend and extend toward the mating surface to form a first buckling portion, and the first buckling portions are buckled and fixed in the third grooves.

In certain embodiment, the first buckling portions are provided with through holes, and two sides of the second fixing portion are exposed at the through holes.

In certain embodiment, two side edges of the second fixing portion bend and extend toward a direction away from the matching surface to form second buckling portions, and the second buckling portions urge against left and right sides of the second groove.

In certain embodiment, the electrical connector further includes multiple third terminals. Each of the third terminals has a third contacting portion fixed on the mating surface. In a front and back direction, the second contacting portion is located between the third contacting portions and the first contacting portion.

In certain embodiment, the electrical connector further includes multiple fourth terminals integrally stamped and formed with the third terminals. Each of the fourth terminals is provided with a fourth contacting portion exposed out of the mating surface. The fourth contacting portions and the second contacting portion are located on the same straight line.

In certain embodiment, the main body is provided with a side wall. The first fixing portion extends toward the side wall to form a first connecting portion. The first connecting portion extends backward to form a first soldering portion. The second fixing portion extends backward to form a second soldering portion. The first soldering portion and the second soldering portion are arranged side by side.

Compared with the related art, when the electrical connector according to certain embodiments of the present invention is mated with the mating connector, the first contacting portion and the second contacting portion are not easily warped. The first contacting portion located in the front is formed by bending and extending forward, the second contacting portion located in the rear is formed by reversely bending and extending backward. The first contacting portion and the second contacting portion are oppositely arranged and have a certain distance therebetween, so that no matter whether the mating connector is inserted or pulled out, direct contact between the first contacting portion and the second contacting portion cannot be generated. The separating plate separates the first terminal from the second terminal. Because of the support of the separating plate, the first contacting portion cannot directly contact with the second extending portion. Only when the mating connector is inserted, the first terminal and the second terminal form an electrical circuit through the mating terminal, thus improving detection accuracy.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
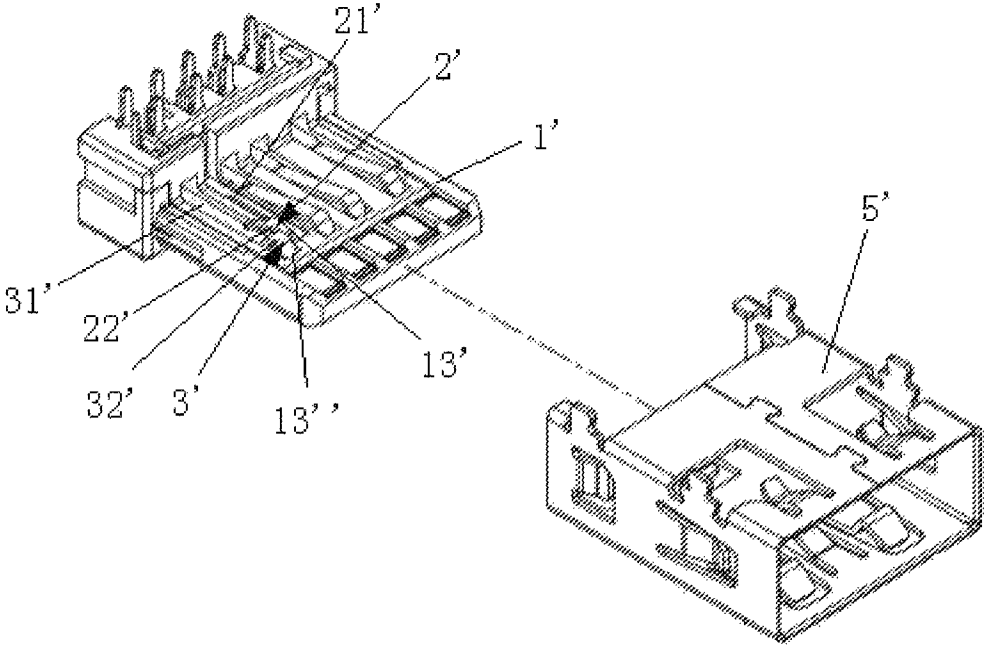
FIG. 1 (Prior Art)
FIG. 1 is an electrical connector in the prior art.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 2:
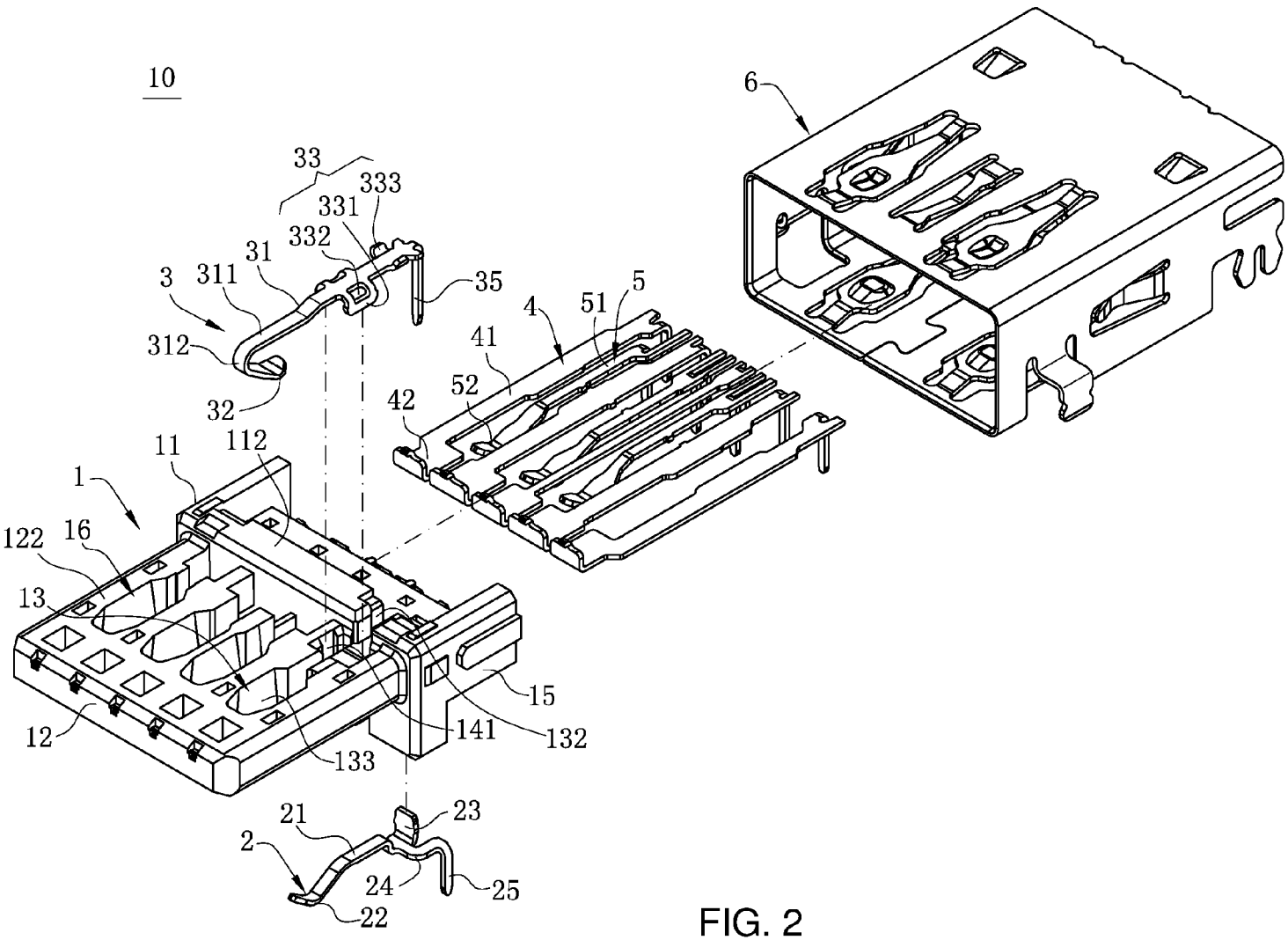
FIG. 2 is a schematic three-dimensional exploded view of an electrical connector according to one embodiment of the present invention.
Figure 3:
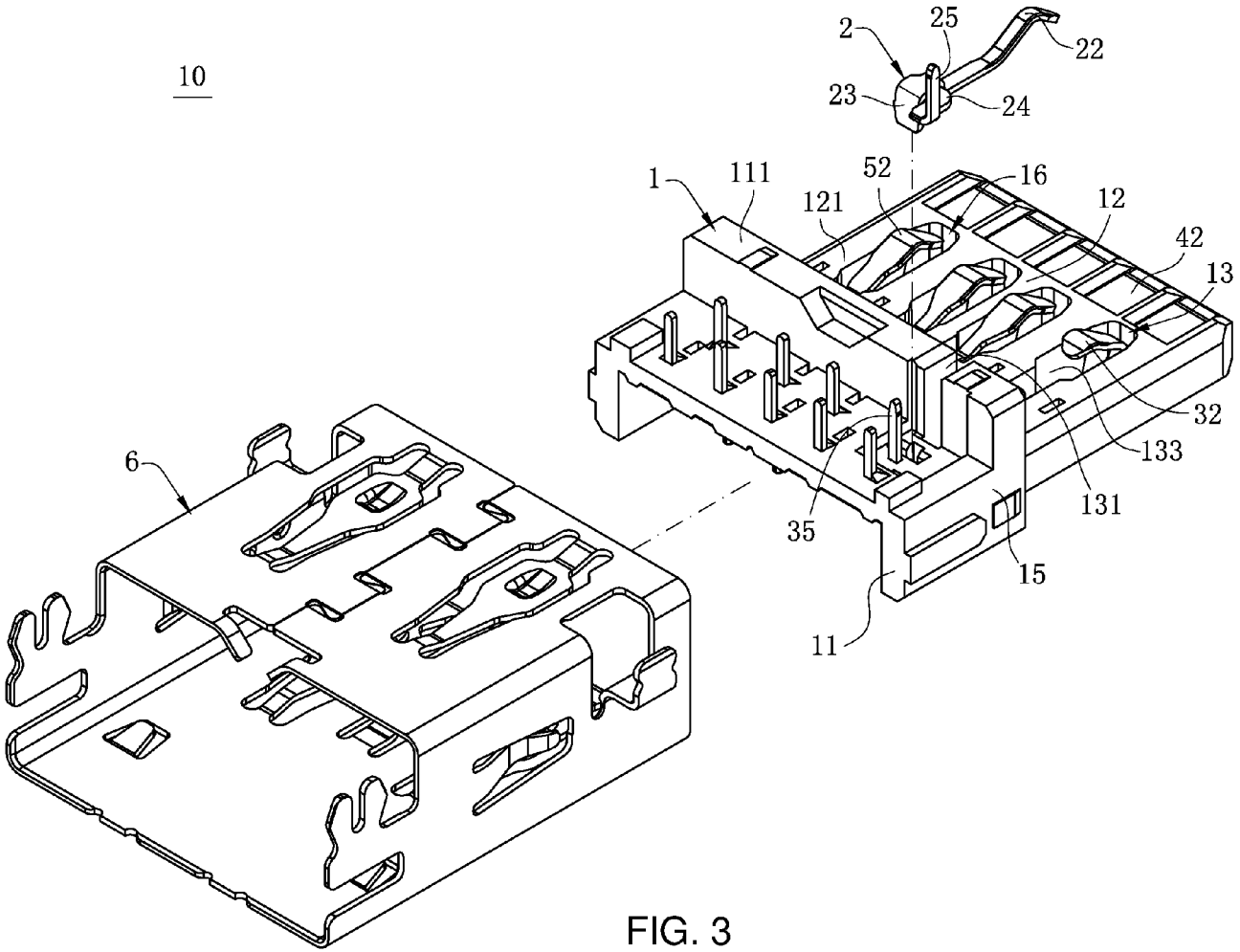
FIG. 3 is a partial three-dimensional exploded view of the electrical connector.
Figure 4:
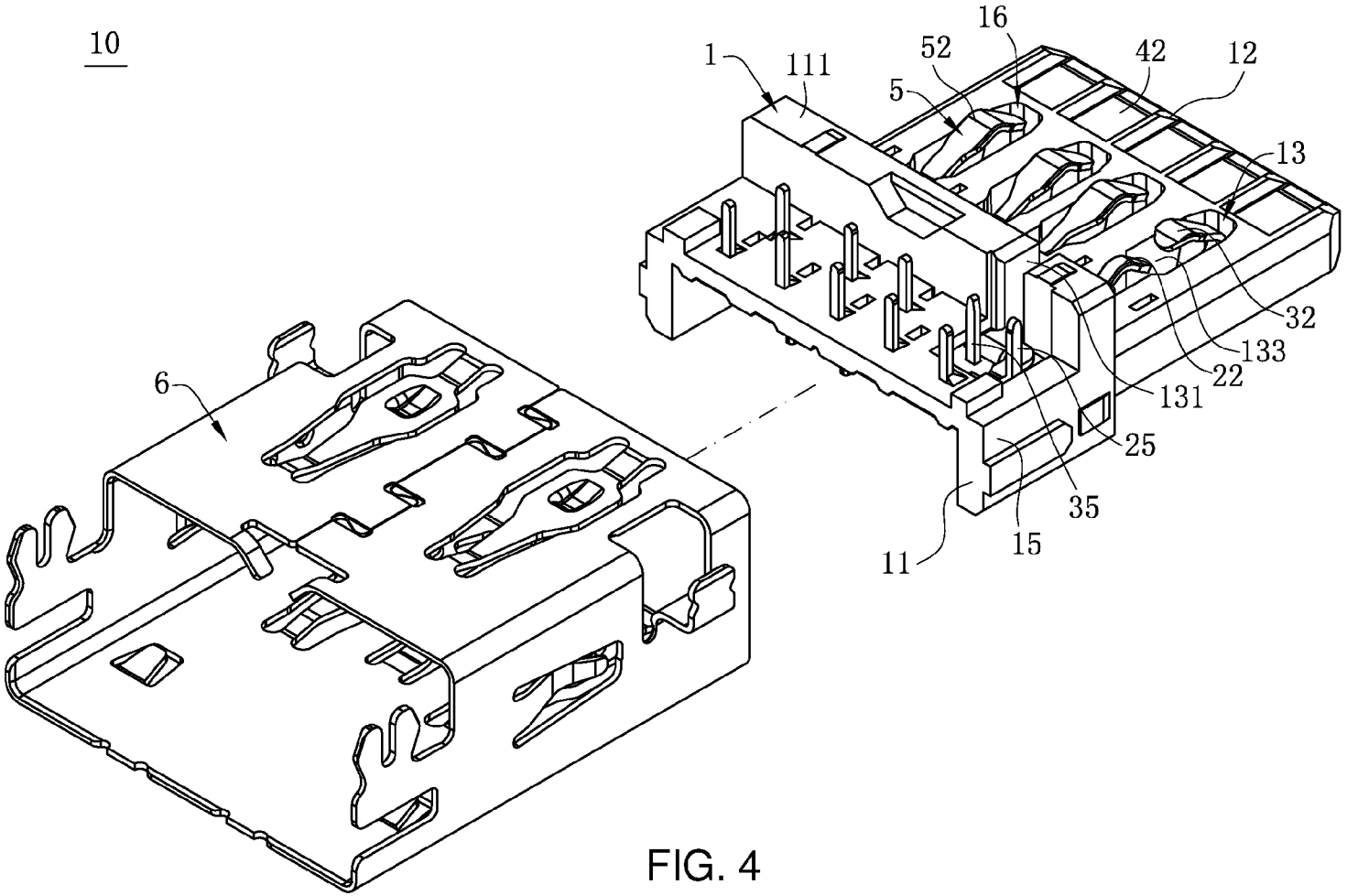
FIG. 4 is a partial three-dimensional exploded view of the electrical connector from another angle.

Referring to FIGS. 2-4, an electrical connector 10 includes an insulating body 1, a first terminal 2 having a detection function, a second terminal 3, multiple third terminals 4, and multiple fourth terminals 5, and a metal shell 6 covering the periphery of the insulating body 1.

Figure 5:
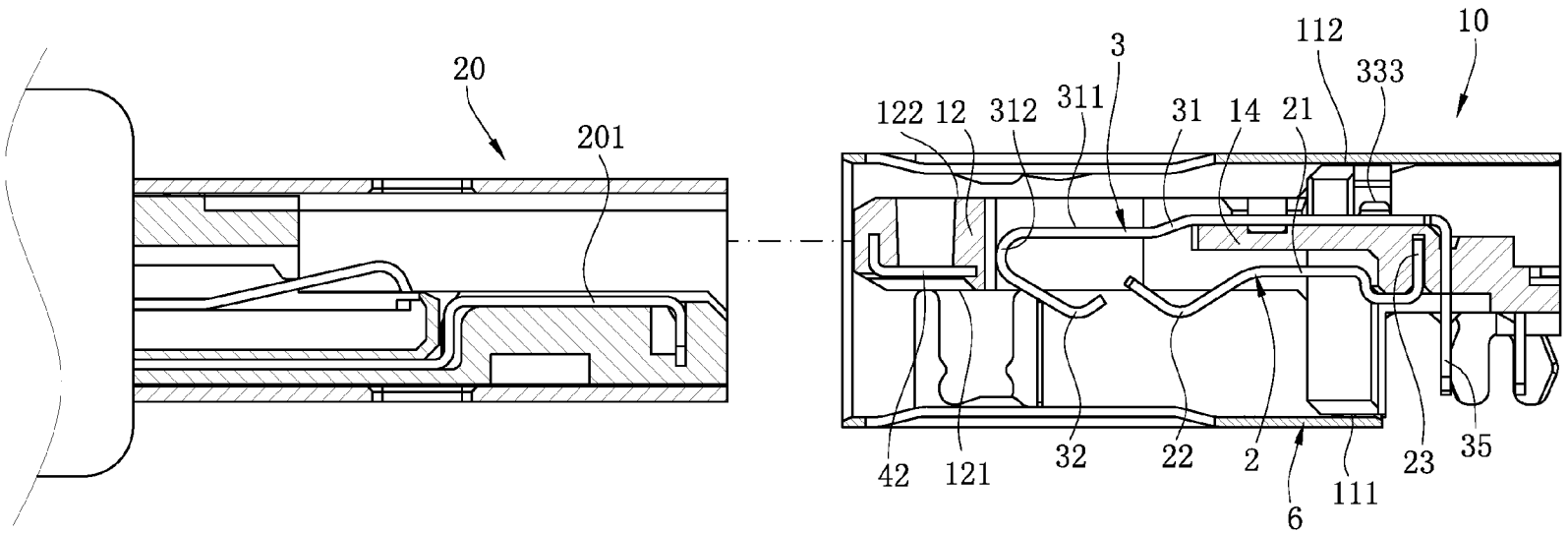
FIG. 5 is a sectional view of the electrical connector before the electrical connector connects with a mating connector.

Referring to FIGS. 2, 3 and 5, the insulating body 1 is provided with a main body 11 and a tongue 12 extending forward from the main body 11. The tongue 12 is provided with a mating surface 121 and a matching surface 122 opposite to the mating surface 121. The main body 11 is provided with a first surface 111 located on the same side with the mating surface 121, and a second surface 112 located on the same side with the matching surface 122.

The main body 11 is provided with a first terminal slot 13. The first terminal slot 13 extends to the mating surface 121 of the tongue 12. The first terminal slot 13 has a first groove 131 recessed from the first surface 111 to the inside of the main body 11, a second groove 132 recessed from the second surface 112 to the inside of the main body 11, and a through slot 133 running through the mating surface 121 and the matching surface 122.

In certain embodiments, the first terminal slot 13 is internally provided with a separating plate 14 extending from the main body 11 to the through slot 133. The first groove 131 and the second groove 132 are located on two opposite sides of the separating plate 14. Left and right sides of the separating plate 14 are respectively recessed from the matching surface 122 of the tongue 12 toward the mating surface 121 of the tongue 12 to form a third groove 141. The third grooves 141 do not run through the mating surface 121 of the tongue 12.

Referring to FIGS. 2-4, the first terminal 2 is assembled upward from the first surface 111 and received in the first terminal slot 13. The first terminal 2 has a first extending portion 21. The first extending portion 21 forms an elastic first contacting portion 22 exposed out of the mating surface 121 of the tongue 12 and exposed outside the through slot 133. The first extending portion 21 extends backward to form a first fixing portion 23, and the first fixing portion 23 is fixed in the first groove 131.

Figure 7:
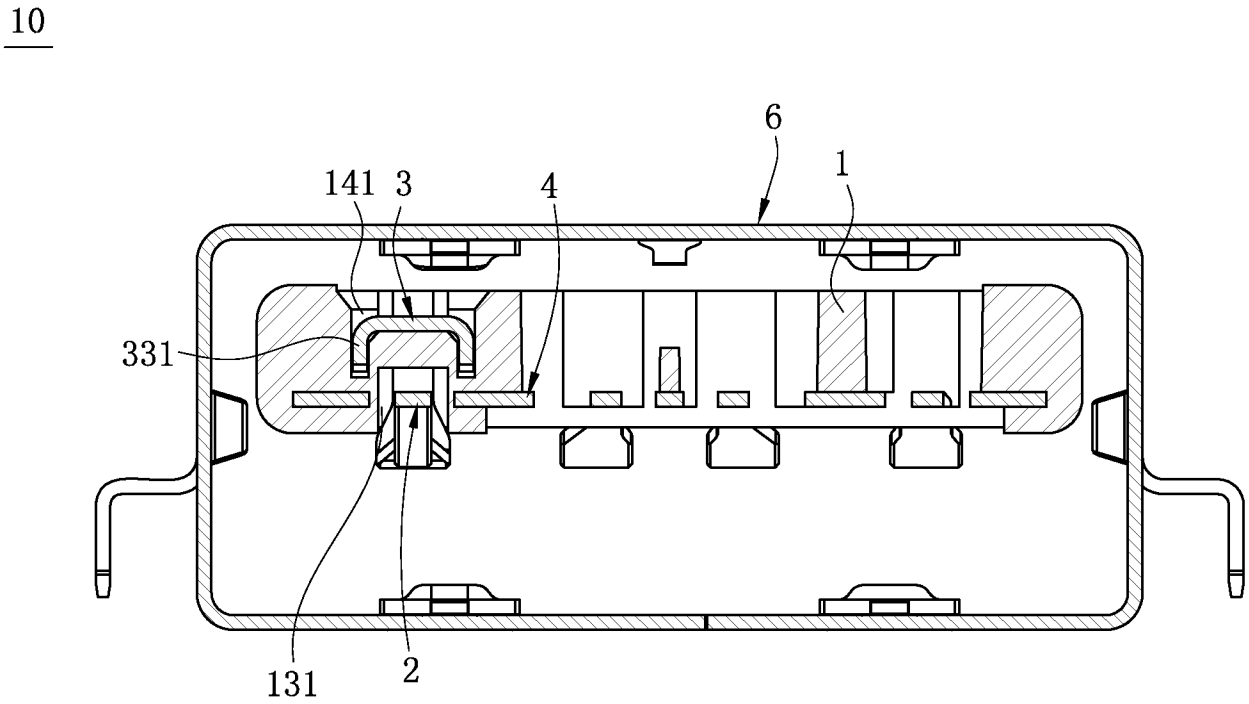
FIG. 7 is a sectional view of the electrical connector along an A-A' surface of FIG. 6.

Referring to FIGS. 2, 4 and 7, the second terminal 3 is arranged above the first terminal 2. The second terminal 3 is assembled downward from the second surface 112 and received in the first terminal slot 13. The second terminal 3 has a second extending portion 31. The second extending portion 31 is away from the mating surface 121 of the tongue 12 relative to the first extending portion 21. The second extending portion 31 extends forward from the front end of the separating plate 14 to form a connecting portion 311. The front end of the connecting portion 311 bends and extends downward to form a bending portion 312, the bending portion 312 bends and extends backward to form an elastic second contacting portion 32. The second contacting portion 32 exposes out of the mating surface 121 of the tongue 12, and is exposed outside the through slot 133.

The second contacting portion 32 is located in front of the first contacting portion 22, and projections of the first extending portion 21 and the second extending portion 31 on the mating surface 121 or the matching surface 122 are overlapped. The separating plate 14 is arranged between the first extending portion 21 and the second extending portion 31.

The second extending portion 31 extends backward to form a second fixing portion 33. The second fixing portion 33 is retained in the second groove 132 and the through slot 133. Two side edges of the second fixing portion 33 respectively bend and extend to the mating surface 121 to form a first buckling portion 331. The first buckling portions 331 are buckled and fixed in the third grooves 141. In certain embodiments, the first buckling portions 331 are provided with through holes 332, and two sides of the second fixing portion 33 expose from the through holes 332. Two side edges of the second fixing portion 33 bend and extend to a direction away from the matching surface 122 to form second buckling portions 333, and the second buckling portions 333 mate left and right sides of the second groove 132.

The main body 11 is provided with a side wall 15. The first fixing portion 23 extends to a direction of the side wall 15 to form a first connecting portion 24. The first connecting portion 24 extends backward to form a first soldering portion 25. The second fixing portion 33 extends backward to form a second soldering portion 35. The first soldering portion 25 and the second soldering portion 35 are arranged side by side.

Referring to FIGS. 2-4, the multiple third terminals 4 include two pairs of differential signal terminal pairs located on two sides and a grounding terminal arranged between the two pairs of differential signal terminal pairs. Each of the third terminals 4 has a third extending portion 41 located in the main body 11 and extending to the tongue 12 and a flat plate shaped third contacting portion 42 extending forward from the third extending portion 41. The third contacting portions 42 are exposed and fixed on the mating surface 121. In a front and back direction, the second contacting portion 32 is located between the third contacting portions 42 and the first contacting portion 22.

Figure 8:
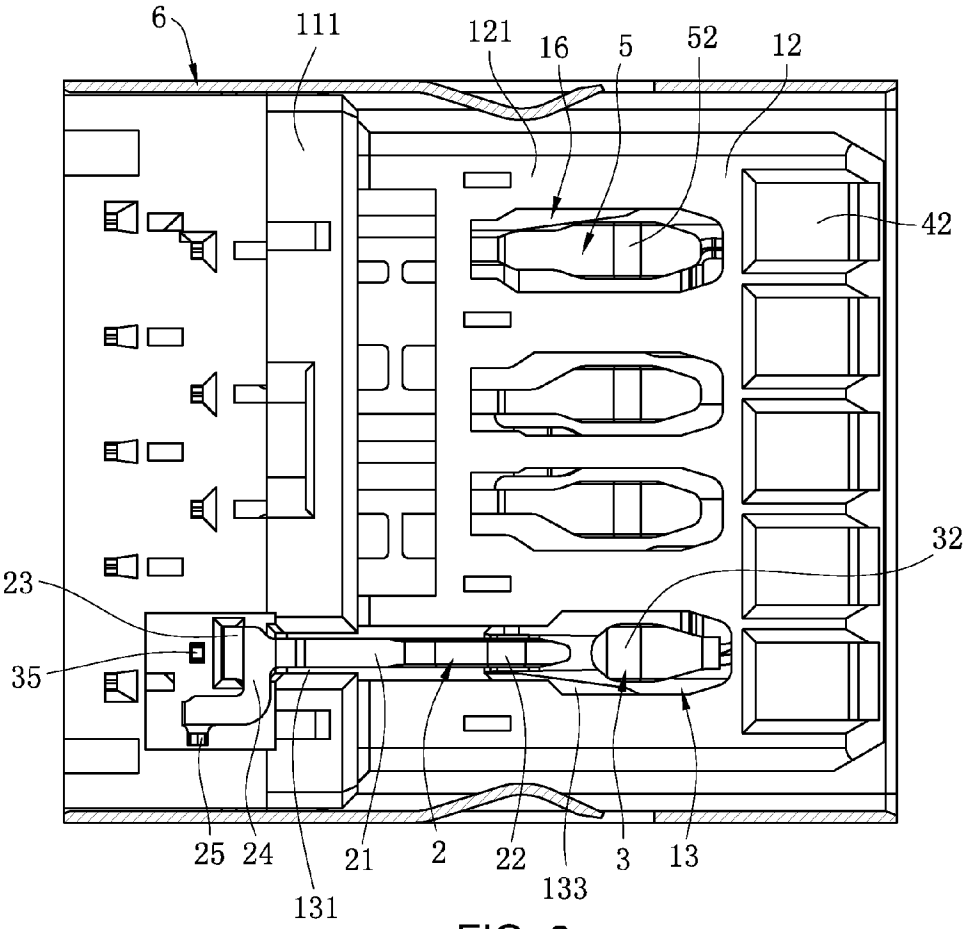
FIG. 8 is a partial top view of the electrical connector.

Each of the fourth terminals 5 has a fourth extending portion 51 located in the main body 11 and extended to the tongue 12. An elastic fourth contacting portion 52 extends forward from each of the fourth extending portions 51. The fourth contacting portions 52 are exposed outside the mating surface 121. As shown in FIG. 8, the tongue 12 is provided with second terminal slots 16 arranged in one row with the first terminal slot 13. The fourth contacting portions 52 are respectively arranged at the second terminal slots 16, and the fourth contacting portions 52 and the second contacting portion 32 are located on the same straight line. Therefore, the first terminal 2 and the second terminal 3 are jointly located at the first terminal slot 13, and the fourth terminals 5 are located at the second terminal slots 16.

Referring to FIG. 2 and FIG. 4, the third terminals 4 and the fourth terminals 5 are insert-molded with the insulating body 1. In certain embodiments, the fourth terminals 5 and the second terminal 3 jointly achieve signal transmission and power supply of the electrical connector 10. In other embodiments, the third terminals 4, the fourth terminals 5, and the second terminal 3 jointly achieve signal transmission and power supply of the electrical connector 10.

Figure 6:
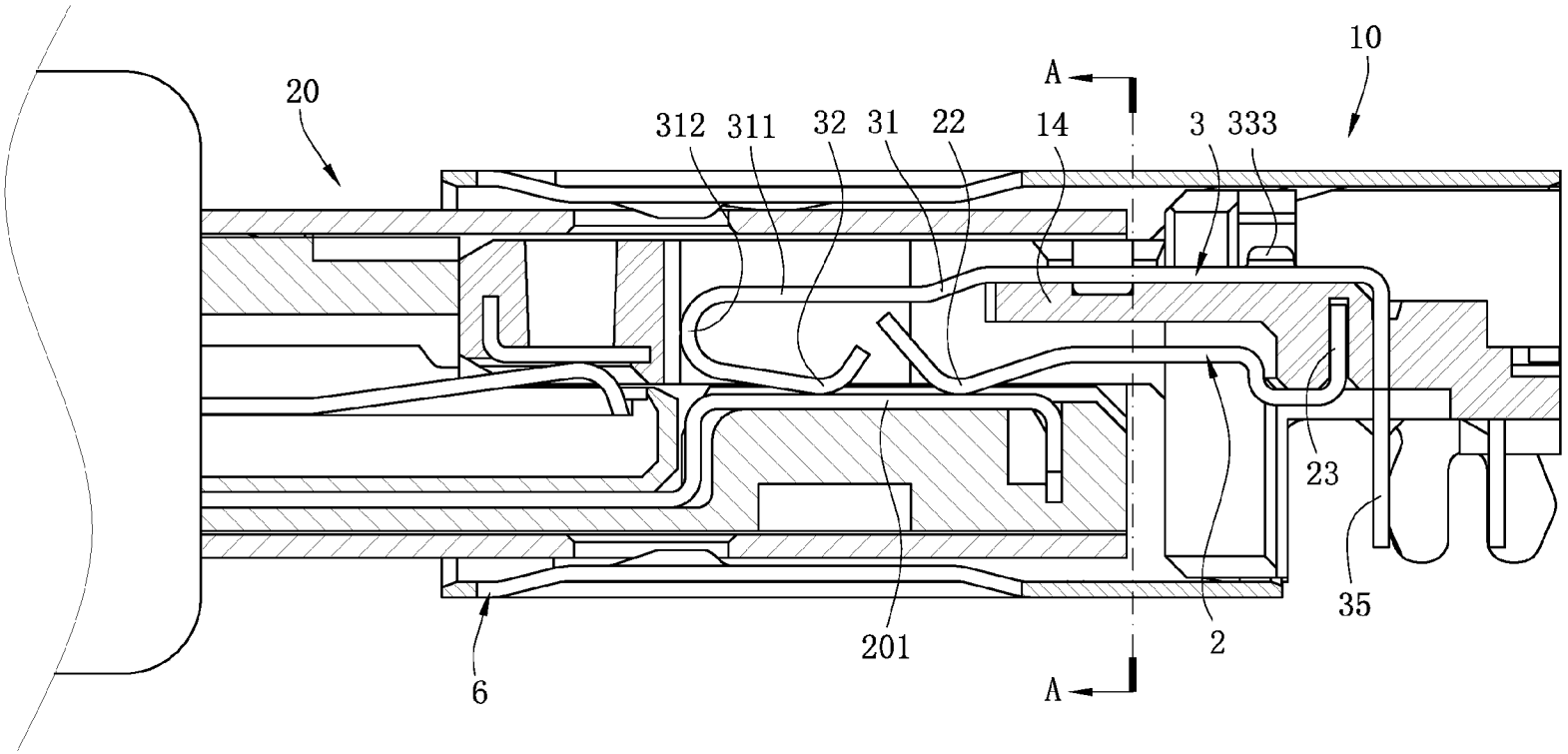
FIG. 6 is a sectional view of the electrical connector after the electrical connector connects with the mating connector.

Referring to FIG. 5 and FIG. 6, the mating connector 20 includes at least one mating terminal 201. When the electrical connector 10 is mated with the mating connector 20, the first contacting portion 22 and the second contacting portion 32 both contact with the mating terminal 201, and the first terminal 2 and the second terminal 3 form an electrical circuit to achieve a detection function. Specifically, when the mating connector 20 is inserted, the mating terminal 201 firstly contacts with the second contacting portion 32 of the second terminal 3, and along with the continuation of insertion, the mating terminal 201 then contacts with the first contacting portion 22 of the first terminal 2, such that the first terminal 2 and the second terminal 3 form the electrical circuit. Hence, mating with the mating connector 20 has been completely achieved.

In summary, compared with the related art, the electrical connector according to certain embodiments of the present invention has the following beneficial advantages.

(1) The first terminal 2 is a detection terminal. The first terminal 2 and the second terminal 3 are respectively assembled at the first terminal slot 13 from the lower side and the upper side, so that the detection terminal does not additionally occupy the space of the tongue 12, thus simplifying the structure of the insulating body 1.

(2) The first extending portion 21, the first contacting portion 22 and the first fixing portion 23 are located on the same straight line, and the second extending portion 31, the second contacting portion 32 and the second fixing portion 33 are located on the same straight line, thus being good for the structure stability of the first terminal 2 and the second terminal 3. When contacting with the mating terminal 201, the first contacting portion 22 and the second contacting portion 32 are not easily warped.

(3) The first contacting portion 22 is formed by extending forward, the second contacting portion 32 reversely bends and extends from front to back, and the first contacting portion 22 and the second contacting portion 32 are oppositely arranged and have a certain distance therebetween, so that no matter whether the mating connector 20 is inserted or pulled out, direct contact between the first contacting portion 22 and the second contacting portion 32 cannot be generated; and only when the mating connector 20 is inserted, the first terminal 2 and the second terminal 3 can form an electrical circuit by means of the mating terminal 201, thus improving detection accuracy.

(4) The separating plate 14 separates the first extending portion 21 from the second extending portion 31. Because of the support of the separating plate 14, the first contacting portion 22 cannot directly contact with the second extending portion 31. Only when the mating connector 20 is inserted, the first terminal 2 and the second terminal 3 can form the electrical circuit through the mating terminal 201, thus avoiding false detection.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for connecting a mating connector, comprising:

a main body provided with a first terminal slot;

a tongue extending forward from the main body, the first terminal slot extending to a mating surface of the tongue;

a first terminal, having a first extending portion received in the first terminal slot, and a first contacting portion extending from the first extending portion and exposed from the mating surface of the tongue; and a second terminal, having a second extending portion received in the first terminal slot, and a second contacting portion extending toward the mating surface of the tongue and bending backward from the second extending portion, wherein the second extending portion is away from the mating surface of the tongue relative to the first extending portion, the second contacting portion exposes out of the mating surface of the tongue, and the second contacting portion and the first contacting portion are arranged in a front and back direction, wherein when the electrical connector connects with the mating connector, the first terminal and the second terminal simultaneously contact with the mating connector, so as to form an electrical circuit.

2. The electrical connector of claim 1, wherein the mating connector has at least one mating terminal, and both the first terminal and the second terminal contact with the mating terminal.

3. The electrical connector of claim 1, wherein the tongue has a matching surface opposite to the mating surface, the main body has a first surface located on a same side with the mating surface and a second surface located on a same side with the matching surface, and the first terminal slot comprises a first groove recessed from the first surface toward an inside of the main body, a second groove recessed from the second surface to the inside of the main body, and a through slot running through the mating surface and the matching surface.

4. The electrical connector of claim 3, wherein the first terminal slot is internally provided with a separating plate extending from the main body to the through slot, the first groove and the second groove are located on two opposite sides of the separating plate, the first extending portion extends backward to form a first fixing portion, the first fixing portion is retained in the first groove, the second extending portion extends backward to form a second fixing portion, the second fixing portion is retained in the second groove and the through slot, and the first contacting portion and the second contacting portion are exposed outside the through slot.

5. The electrical connector of claim 4, wherein left and right sides of the separating plates are respectively provided with a third groove recessed from the matching surface toward the mating surface, two side edges of the second fixing portion respectively bend and extend to the mating surface to form a first buckling portion, and the first buckling portions are buckled and fixed in the third groove.

6. The electrical connector of claim 5, wherein each of the first buckling portions is provided with a through hole, and two sides of the second fixing portion expose from the through holes.

7. The electrical connector of claim 5, wherein two side edges of the second fixing portion bend and extend toward a direction away from the matching surface to form second buckling portions, and the second buckling portions urge against left and right sides of the second groove.

8. The electrical connector of claim 4, wherein the main body is provided with a side wall, the first fixing portion extends toward the side wall to form a first connecting portion, the first connecting portion extends backward to form a first soldering portion, the second fixing portion extends backward to form a second soldering portion, and the first soldering portion and the second soldering portion are arranged side by side.

9. The electrical connector of claim 1, further comprising a plurality of third terminals provided on the main body, wherein each of the third terminals has a third contacting portion exposed on the mating surface, and in a front and back direction, the second contacting portion is located between the third contacting portions and the first contacting portion.

10. The electrical connector of claim 9, further comprising a plurality of fourth terminals provided on the main body, wherein each of the fourth terminals has a fourth contacting portion exposed out of the mating surface, the tongue is provided with a plurality of second terminal slots arranged in one row with the first terminal slot, the fourth contacting portions are arranged at the second terminal slots, and the fourth contacting portions and the second contacting portion are located on the same straight line.

* * * * *